United States Patent [19]

Humble et al.

[11] Patent Number: 4,792,018

[45] Date of Patent: Dec. 20, 1988

[54] SYSTEM FOR SECURITY PROCESSING OF RETAILED ARTICLES

[75] Inventors: David R. Humble, Deerfield Beach; David L. Gentzler, Boynton Beach; Steven J. Tilidetzke, Coconut Creek, all of Fla.

[73] Assignee: CheckRobot Inc., Deerfield Beach, Fla.

[21] Appl. No.: 742,757

[22] Filed: Jun. 12, 1985

Related U.S. Application Data

[63] Continuation-in-part of Ser. No. 628,913, Jul. 9, 1984, Pat. No. 4,676,343.

[51] Int. Cl.[4] ..... G07C 11/00

[52] U.S. Cl. ..... 186/61; 177/50; 186/59; 235/383; 235/437; 340/572; 364/560; 364/567

[58] Field of Search ..... 186/56, 59, 61, 62, 186/68; 235/91 L, 383, 385, 480; 209/534, 567, 569, 576, 925; 177/50–52; 340/551, 552, 572, 825.31, 825.32, 825.35; 364/403, 404, 478, 560, 562, 567, 581

[56] References Cited

U.S. PATENT DOCUMENTS

| | | | |
|---|---|---|---|
| 3,436,968 | 4/1969 | Unger et al. | 364/567 X |
| 3,511,372 | 5/1970 | Kantarian et al. | 209/576 X |
| 3,681,570 | 8/1972 | Abt | 235/91 L X |
| 3,681,571 | 8/1972 | Strohschneider | 235/383 |
| 3,734,286 | 5/1973 | Simjian | 177/52 X |
| 3,832,530 | 8/1974 | Reitboeck et al. | 340/551 X |
| 4,071,740 | 1/1978 | Gogulski | 186/61 X |
| 4,137,567 | 1/1979 | Grube | 364/567 |
| 4,239,434 | 12/1980 | Gannon | 364/567 X |
| 4,470,496 | 9/1984 | Steiner | 194/200 |
| 4,676,343 | 6/1987 | Humble et al. | 186/61 |

FOREIGN PATENT DOCUMENTS

| | | | |
|---|---|---|---|
| 2114676 | 4/1978 | Fed. Rep. of Germany | 235/383 |
| 899018 | 6/1984 | France . | |

*Primary Examiner*—Kevin P. Shaver

*Attorney, Agent, or Firm*—Robin, Blecker & Daley

[57] ABSTRACT

A system for processing articles selected for purchase and bearing distinct identification codes comprises, in one version: (a) a code reader for generating an output signal indicative of such article identification code; (b) a conveyor for receipt and transport of such article; (c) an entrance sentry for defining an inlet to a secured zone extending along a portion of the conveyor and for generating an output signal indicative of entry of the article into the secured zone and of a measurable characteristic of the article; and (d) a controller for selective movement of the conveyor in respective article acceptance and article rejection senses. The controller is operable in several respects, namely, for storage, for each of a plurality of such articles, of a signal indicative of a predetermined value of the measurable article characteristic correlated with such article identification code, for response to the code reader output signal for comparison of such stored signal with the output signal of the sentry, and for operation of the conveyor selectively in response to the results of such comparison.

17 Claims, 8 Drawing Sheets

SYSTEM FOR SECURITY PROCESSING OF RETAILED ARTICLES

CROSS-REFERENCE TO RELATED APPLICATION

This application is a continuation-in-part of commonly-assigned application Ser. No. 628,913, filed in the names of applicants herein on July 9, 1984 and entitled "SELF-SERVICE DISTRIBUTION SYSTEM" now U.S. Pat. No. 4,676,343.

FIELD OF THE INVENTION

The present invention relates generally to security systems and methods for processing retailed articles and pertains more particularly to systems and methods for safeguarding operator-unattended checkout of purchased articles in supermarkets and like facilities against customer fraud.

BACKGROUND OF THE INVENTION

One type of prior art system for operator-unattended supermarket checkout of articles is shown in Otis U.S. Pat. No. 2,919,851, which issued on Jan. 5, 1960. In an aspect of the Otis system intended to provide some safeguard against customer fraud, a distinct machine-discernible code is assigned to each article as is a machine-discernible of the weight of such article within a given tolerance range. The code and weight indication are discerned for articles selected for purchase and the weights thereof are totalized with tolerance. The customer is required to place the shopping bag containing all selected articles in a restricted area which has a weight scale providing electrical signal output of the measured weight. If the measured weight signal corresponds with the totalized weight derived from the code and machine-discernible weight indication, the Otis system does not reject the transaction. However, where there is not the required correspondence, the Otis system directs the customer to consult the store manager, who then inspects the details of the transaction. A further facet of the Otis system is to provide machine-discernible price indication for each article and to provide a printed record of the details of the transaction with price totalization.

A second type of prior art system is seen in both Abt U.S. Pat. No. 3,681,570 and Strohschneider U.S. Pat. No. 3,681,571, both of which are assigned in common to Zellweger Ltd. and issued on Aug. 1, 1972. Such '570/571 system is generally of the Otis type, i.e., accepting or rejecting a transaction on the basis of a comparison of a measured article characteristic with a preassigned value therefor, correlated with article indentification code. Articles are examined in the '570/571 system on a per article basis and accepted articles are conveyor-transported to a secured container, which is unaccessible to the customer until after payment, i.e., there is no human intervention, such as the bagging of individual accepted articles, until all selected articles are found acceptable and paid for. Articles which are rejected in the '570/571 system are transported to a second (rejection) conveyor and returned to the customer.

In the system of the commonly assigned '913 patent application, which is also of type involving use of article identification code, measured article characteristic and comparison with a stored value thereof, a customer passes an article selected for purchase through a UPC (universal product code) reader and then places the article upon an entry conveyor. Such conveyor transports the article through an entry "light curtain". The light curtain defines the inlet of a secured zone or "security tunnel", which includes therein an exit light curtain at the end of the entry conveyor and at the beginning of a second, exit conveyor. Article weight is measured in the course of residence of the article on the entry conveyor and the light curtains safeguard against customer fraud by sensing violation thereof by the customer, e.g., the customer reaching into the secured zone for the purpose of substituting another article for the article whose UPC was scanned. Should the customer elect to substitute an article having different weight than the scanned article, after UPC scanning but prior to entry of the article into the security zone, the weight comparison will otherwise reject the article. In either case of article rejection, the direction of the entry conveyor is reversed and the article is returned to the customer. An interactive display console is provided for communication of the rejection to the customer and for various other communications between the customer and the system. Articles accepted by the system are passed along to the exit conveyor for conveyance from the secured zone to a bagging area fully accessible to the customer. The system issues a receipt to the customer for use in payment at a cashing station. The pedestrian passage about the system may include an EAS (electronic surveillance system) to defeat circumvention of the system by the customer carrying articles thereby. Various other refinements attend the system of the '913 application, to which incorporating reference is hereby made. Thus, light sensors are provided at plural locations in the bagging area for other purposes and the system can also accommodate plural articles in residence on the entry conveyor and effecting the weighting scale at common times.

While the system of the '913 application, in applicants' view, substantially enhances performance and security over that obtaining in the prior systems discussed above, they are of the persuasion that further refinement thereof is desired for satisfactory commercialization thereof.

SUMMARY OF THE INVENTION

The primary object of the present invention is to provide improved system and method for operator-unattended retailing of consumer articles.

A more particular object of the invention is to provide plural bases for the rejection of articles fraudulently sought by customers in such operator-unattended retail facilities.

A further object of the invention is to provide impoved system and method for implementing a store of information useful in the operation of an operator-unattended article merchandizing facility.

In the effective attainment of these and other objects, the invention provides a system for processing articles selected for purchase and bearing distinct identification codes, the system comprising in a first version (a) a code reader for generating an output signal indicative of such article identification code; (b) a conveyor for receipt and transport of such article; (c) an entrance sentry for defining an inlet to a secured zone extending along a portion of the conveyor and for generating an output signal indicative of entry of the article into the secured zone and of a measurable characteristic of the article;

and (d) a controller for selective movement of the conveyor in respective article acceptance and article rejection senses. The controller is operable in several respects, namely, for storage, for each of a plurality of such articles, of a signal indicative of a predetermined value of the measurable article characteristic correlated with such article identification code, for response to the code reader output signal for comparison of such stored signal with the output signal of the sentry, and for operation of the conveyor selectively in response to the results of such comparison.

In such system first version, the sentry may comprise the light curtain of the '913 application, modified, however, to provide an output signal indicative of the article shape. The controller storage will, in this instance, include a compilation of article shape correlated with article UPC.

The system first version may further include an additional code reader in the secured zone for generating an output signal indicative of such code, the controller being operative for further comparing the output signal of the first-mentioned code reader with the output signal of the additional code reader and operating the conveyor selectively in response to such further comparison.

A further variant of the system first version would include therein as EAS detection unit for determining whether or not an article in the security zone is EAS-tagged, the controller being operative for storing indication, for each of a plurality of such articles, of whether or not such article should be EAS-tagged and operating the conveyor selectively in response to such stored indication and determination.

In still another variation of the system first version, the controller is itself operative for compiling a store, for each of a plurality of such articles, of a signal indicative of a predetermined value of the article characteristic correlated with article identification code, by processing of the output signals of the code reader and the sentry.

In a system second version, one can omit the article shape comparison measure of the system first version and substitute usage of the variation first mentioned above, i. e., the additional code reader and comparison of codes read outside and within the secured zone.

In a system third version, one can substitute, for the article shape comparison of the system first version, usage of the EAS detection unit and associated measures above discussed therewith.

Weight measuring and comparison measures may be used with any of the system versions.

A system fourth version would comprise article characteristic measurement and comparison with predetermined article characteristic values stored by operation of the controller itself, by processing of the output signals of an article characteristic sensor and the code reader.

A composite system version may include all of the foregoing aspects of the several above system versions.

The various pemutations and combinations of the separable aspects of the invention and methods thereof will be further understood from the following detailed description of preferred embodiments and from the drawings, wherein like reference numerals identify like parts and components throughout.

DESCRIPTION OF PREFERRED EMBODIMENTS AND PRACTICES

Figure 1:
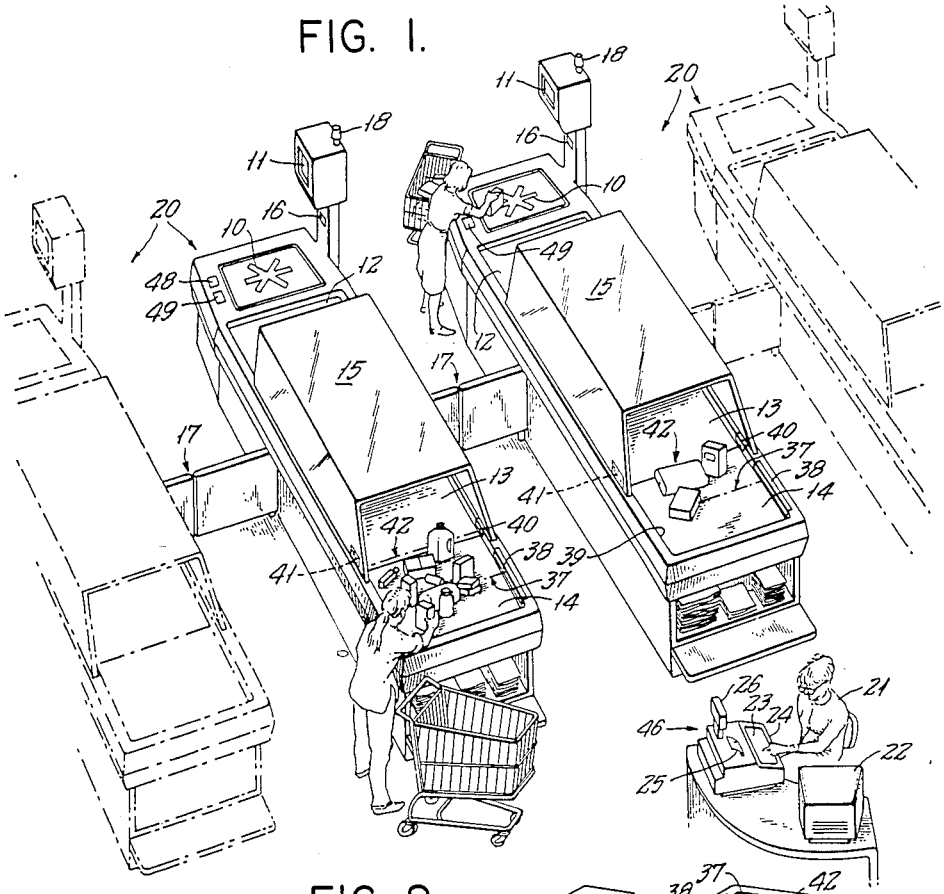
FIG. 1 is a perspective view of a typical checkout area of a supermarket of accordance with the invention, as seen from the point of customer egress.

Referring to FIG. 1, a checkout area in a supermarket includes counters and intervening passageways. Each counter 20 has a laser UPC reader 10, a display screen 11 for interractive customer communication, an infeed or entry conveyor 12, an outfeed or exit conveyor 13, a bagging area 14, a tunnel or secured zone 15, a receipt unit 16 (FIG. 2), passageway control gates 17 and an assistance signal lamp 18.

Figure 3:
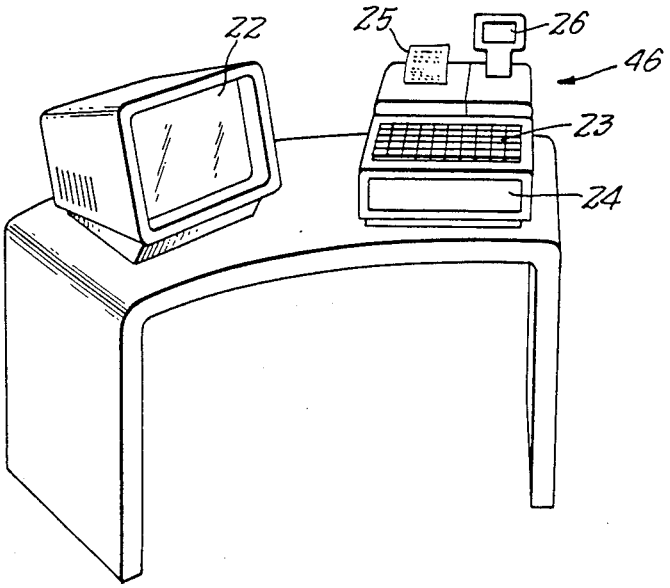
FIG. 3 is a front perspective view of the cashier station forming a part of the embodiment illustrated in FIG. 1.

For each group of checkout counters, there may be a single cashier 21, who is furnished with a master monitor screen 22, a keyboard 23 with cash drawer 24, a final sales slip printer 25, and a customer viewable display 26 (Fig. 3).

In using a checkout counter 20, a customer approaches same with items selected for purchase, usually transported to this point in a conventional shopping cart. If the counter is available for use, the display screen 11 will carry messages such as listed in Table I below.

TABLE I

Hello. This a touch-activated display. Simply touch the screen to the right of the desired message to make your selection.

1. I'm ready to begin scanning. (touch)
2. I need to review the operating instructions before beginning. (touch)
3. Help! I would like assistance. (touch)

As is stated in the introductory message, the display screen 11 is touch sensitive or touch activated by touching with a human finger at any one of a number of predetermined locations. For the particular example, there would be three such locations. Applying a finger to one of the locations is equivalent to operating a switch or pressing a signal button, or the like, and communicates to the system the affirmative response to the associated inquiry displayed on screen 11. For this initial discussion of system usage, it will be assumed that the customer is experienced and will touch the location adjacent Message 1. in Table I.

The customer now passes each item, one by one, UPC code down, over reader 10 and deposits the item on entry conveyor 12. The prices and item identifications may appear now on display screen 11 as the items are transported by the conveyors through secured zone 15 out of reach of the customer to bagging area 14.

When all of the items have been scanned by reader 10 and placed on entry conveyor 12, the customer may again communicate with a different display on screen 11 to initiate presentation to the customer of a printed receipt from receipt unit 16. The customer now takes the receipt and the shopping cart and proceeds through the control gates 17 to the bagging area 14 to bag the items, place the loaded bags in the shopping cart, and then proceeds to cashier 21. Each counter will have a separate identifier, a number, a letter, a combination, or the like, by which it can be identified to the cashier. Such identifier will appear on the printed receipt proffered to the cashier, and it will also appear on the master monitor screen 22 along with the subtotal corresponding to that printed by the receipt unit 16 and stored by the system.

Through the keyboard 23, the cashier can enter credit for any proffered coupons and can add any items that could not be handled automatically by the counter 20, such as oversized items or items without UPC labelling. As the cashier makes entries via keyboard 23, a visual confirmation is provided to the customer by display 26. A final receipt is printed and furnished by printer 25, and the payment transaction is accomplished in conventional manner.

For a self-service, operator-unattended system to be effective, it need include various safeguards to accommodate inadvertent customer mistakes and to insure against attempts either to bypass the system or defraud. Various such measures are included in systems of the invention, now discussed.

Figure 2:
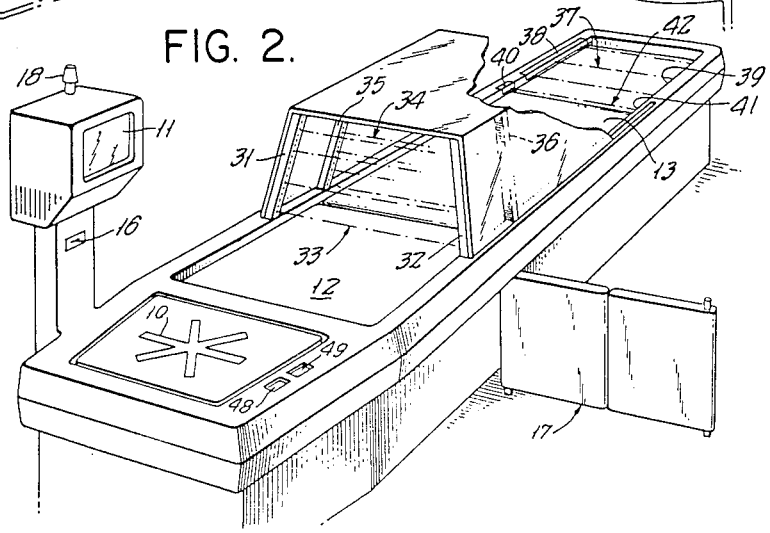
FIG. 2 is a perspective view of one of the checkout stations or counters as used in the embodiment of FIG. 1 as seen from the point of customer entry.
Figure 4:
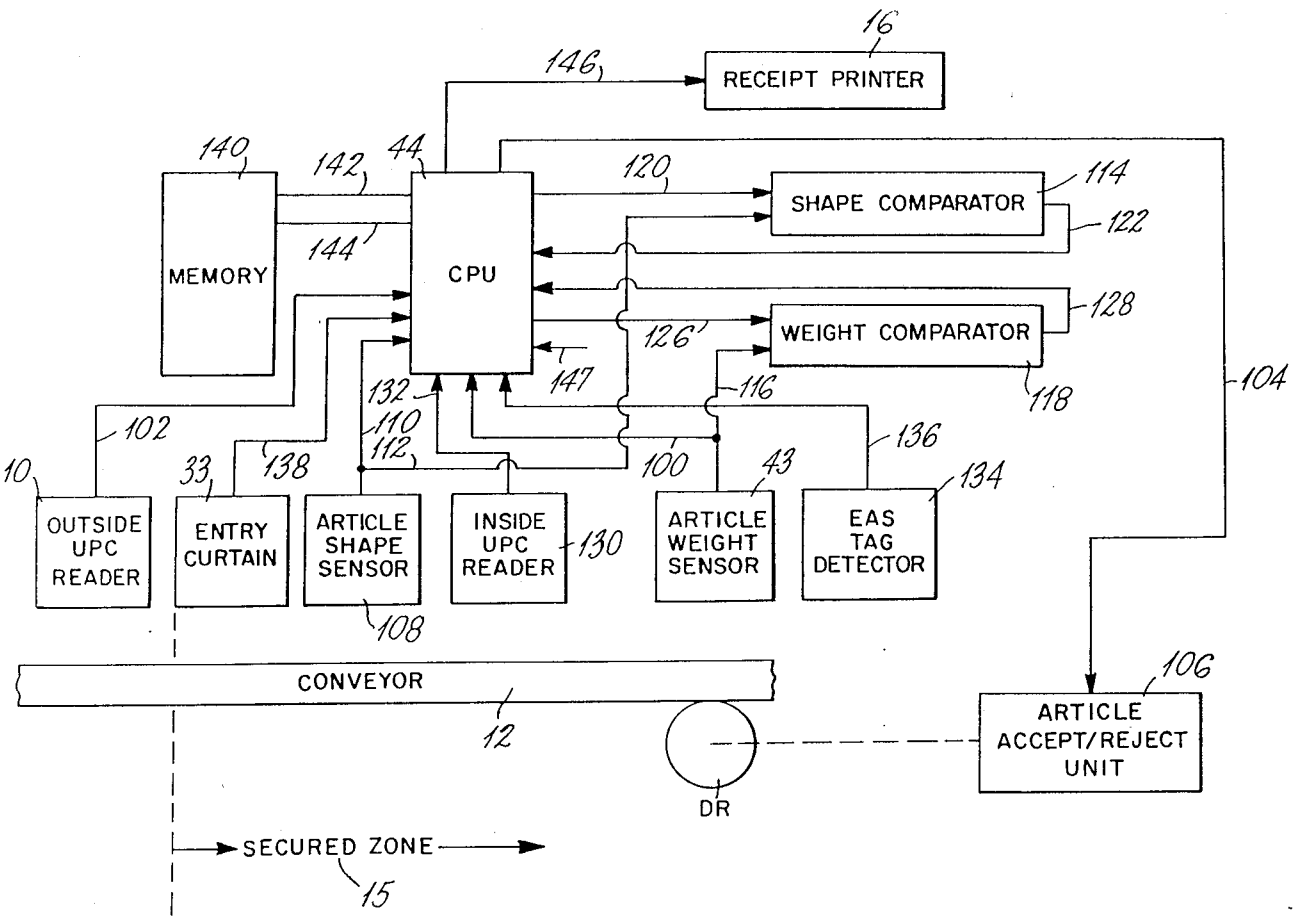
FIG. 4 is a system block diagram of components interconnected to provide a composite system in accordance with the invention.

Referring to FIGS. 1, 2 and 4, each counter 20 has an entrance sentry 33 in the form of an electronic curtain at the entry to its secured zone 15. The curtain is established by an array 31 of LED (light-emitting diode) elements or other light sources mounted along one side of secured zone 15 and cooperating with a corresponding array 32 of photocells, photosensitive diodes, or the like, mounted along the opposite side of secured zone 15.

An exit sentry 34 in the form of a second electronic curtain consisting of an LED array 35 and a photocell or photosensitive diode array 36 is located at the junction between entry conveyor 12 and exit conveyor 13, mounted within the secured zone similarly to sentry 33. While the curtains of sentries 33 and 34 are vertically oriented in the secured zone, a further curtain 37 may be horizontally disposed within bagging area 14 with its LED array 38 located on one side and its photosensitive diode array 39 located on the opposite side. Further, a photobeam assembly comprising a light source 40 and a detector 41 may be provided as a detecting beam 42 located at the intersection between the exit conveyor 13 and bagging area 14. The functioning of the latter curtains is set forth in the above-referenced '913 application.

Turning now to FIG. 4, the various components for implementing versions of the system of FIG. 1 are shown in interconnected block diagram form, as such implementing the composite system version. Beneath entry conveyor 12 is article weight sensor 43 which responds to any change in the weight of the conveyor that is caused by articles being placed thereon or removed therefrom. Sensor 43 may be of any conventional structure and furnishes its output signal to central processing unit (CPU) 44 over line 100.

UPC reader 10, disposed outside of secured zone, furnishes its output signal to CPU 44 over line 102. CPU 44 is connected by line 104 to article accept/reject unit 106, which controls drive roller DR of conveyor 12 to effect selective forward (accept) and reverse (reject) conveyor motion, responsively to the state of line 104.

Figure 5:
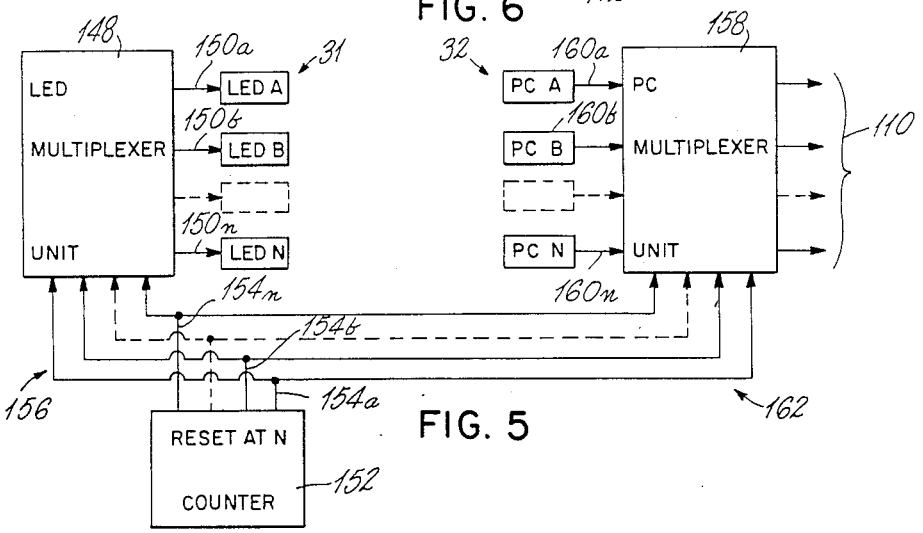
FIG. 5 is a block diagram of an entry light curtain subsystem in accordance with the invention.

Article shape sensor 108, preferably realized integrally with entry curtain 33 as discussed below in connection with FIG. 5, provides output signal indicative of measured article height or shape on lines 110, which furnish same to CPU 44. Line 112 applies this signal also to shape comparator 114. Line 116 applies measured article weight to weight comparator 118. Where height and weight comparators are selected as system features, CPU 44 will, on the basis of predetermined values of height and weight available to it through storage, furnish output signal indicative of stored height on line 120 and shape comparator 114 will compare the height values on lines 112 and 120 and furnish output signal indicative of the result of the comparison over line 122 to CPU 44. Similarly, CPU 44 will furnish output signal indicative of stored weight on line 126 and weight comparator 118 will compare the weight values on lines 116 and 126 and furnish output signal indicative of the result of the comparison over line 128 to CPU 44.

UPC reader 130, disposed within secured zone 15, provides output signal to CPU 44 over line 132 indicative of the UPC of an article in the secured zone. EAS tag detector 134, also disposed within secured zone 15, provides output signal to CPU 44 over line 136 indicative of whether or not an article in the secured zone has or does not have an EAS tag.

Where separate from article shape sensor 108, as in FIG. 4, entry light curtain 33 provides output indication of its interruption to CPU 44 over line 138.

Memory 140 is connected to CPU 44 by lines 142 and 144, for communication therebetween of UPC, weight and shape values for storage, and measured weight and shape values for storage. Line 146 connects CPU 44 to receipt printer 16.

CPU 44 will be seen to have various possible inputs, comprising UPC read outside the secured zone, UPC read inside the secured zone, measured article weight, measured article shape, results of measured and stored weight and height comparisons, entry curtain violation, and presence or absence of EAS tags. A signal may also be provided on line 147 indicating exit curtain violation. CPU 44 operates responsively to such input signals in two main capacities, i. e., in controlling the state of line 104 and hence conveyor movement and in itself compiling the store of predetermined target values for article weight and shape, as will be discussed following comment on suitable structure integrating light curtain 33 and shape sensor 108 and for implementing inside UPC reader 130.

Broadly viewed, CPU 44, comparators 114 and 118 (which may be implemented within the CPU), article accept/reject unit 106 and memory 140 constitute a control means of the system of FIG. 4, governing conveyor movement.

Turning to FIG. 5, LED multiplexer unit 148 provides output signals on lines **150*a*, 150*b* and 150*n* to LED A, LED B and LED C of array 31 of the entry light curtain. The phantom outline of an LED between LED B and LED N is intended to indicate that the showing of FIG. 5 would include many more than the three LEDs therein. Counter 152 is a self-resetting counter and, as labeled, resets to zero count upon reaching its nth count, n being the number of LEDs in array 31. The state of counter 152 is indicated on its output lines 154***a*, 154*b* and 154*n*, and is furnished to multiplexer 148 over lines 156. As counter 152 cycles, multiplexer 148 will selectively energize the LEDs in succession, one at a time.

PC array 32 of the entry light curtain is shown as including corresponding photocells, PC A, PC B, omitted phantom-outlined PCs and PC N, which furnish their output signals to PC multiplexer unit 158 over lines 160*a*, 160*b*, omitted phantom-outlined PC output lines and 160*n*. Lines 162 furnish the state of counter 152 to PC multiplexer unit 158, such that it operates in the same sequence and in time step with LED multiplexer 148. The entry curtain is accordingly stepped in vertical steps and the output lines 110 of PC multiplexer unit 158 will selectively indicate the initial vertical LED-PC pair in communication with one another and hence will indicate article height.

Operation of counter 152 is at high periodic cycling in comparison to the speed of movement of conveyor 12, such that many article height readings are made in the course of article conveyance. Further, the effects of ambient light are preferably overcome by chopping LED excitation at a given frequency, thereby to permit ready discernment in the PCs of LED output energy as contrasted with ambient light.

Figure 6:
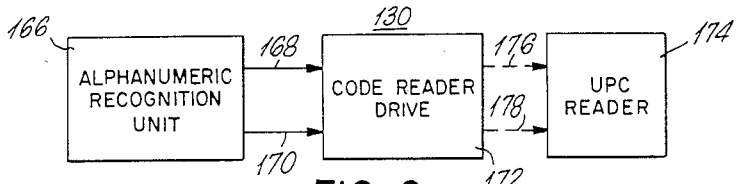
FIG. 6 is a block diagram of a mbole UPC reader usable in practicing the invention.

In FIG. 6 is indicated a version of inside UPC reader 130. Alphanumeric recognition unit 166 is operative to sense and locate article UPC within the secured zone and provides outputs on lines 168 and 170 for vertical and horizontal displacement of code reader drive 172 which supports reader 174 by links 176 and 178 for movement into sensed location for providing output indication of article UPC.

Figure 7:
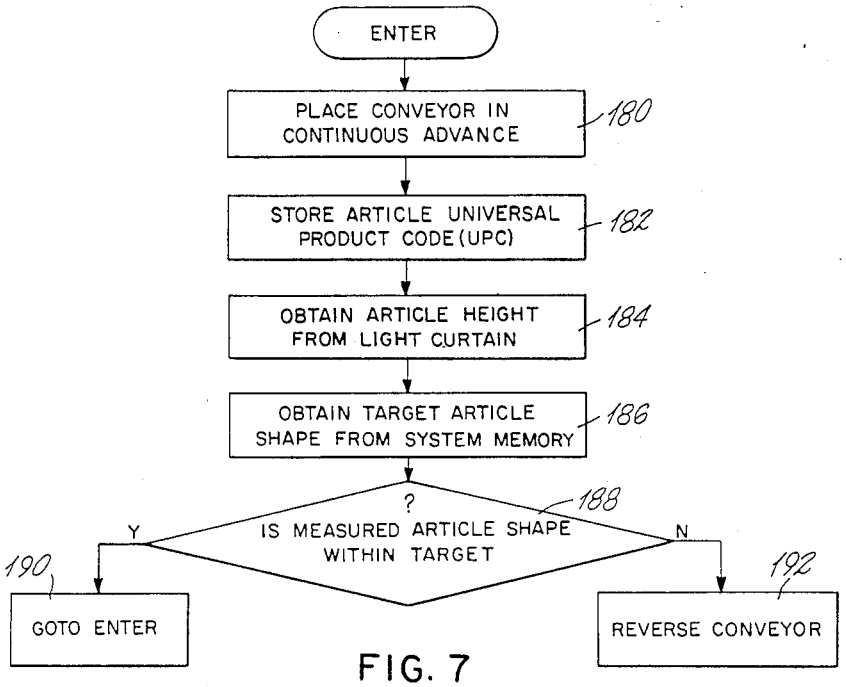
FIGS. 7 through 13 are flowcharts of practices in various versions of systems of the invention.

The first system version in accordance with the invention may have the flow chart indicated in FIG. 7. Following entry of CPU 44 into this program (ENTER), step 180 (PLACE CONVEYOR IN CONTINUOUS ADVANCE) is practiced, wherein conveyor 12 is advanced in direction advancing articles into secured zone 15. In step 182 (STORE ARTICLE UNIVERSAL PRODUCT CODE (UPC)), the UPC read by reader 10 is stored for use in accessing system memory to obtain article shape or other stored article characteristics..

The CPU now, in step 184 (OBTAIN ARTICLE HEIGHT FROM LIGHT CURTAIN), looks to its input lines 110 and determines article height from the entry light curtain. Article predetermined height value is now obtained from storage in step 186 (OBTAIN TARGET ARTICLE SHAPE FROM SYSTEM MEMORY). Decision as to correspondence or non-correspondence in measured and stored article heights is made in step 188 (? IS MEASURED ARTICLE SHAPE WITHIN TARGET), the CPU looking to the state of line 122 of FIG. 4 for the latter decision. Upon article height correspondence, flow proceeds to step 190 (GOTO ENTER). In the case of non-correspondence, flow proceeds to step 192 (REVERSE CONVEYOR), which is an article rejection measure.

Figure 8:
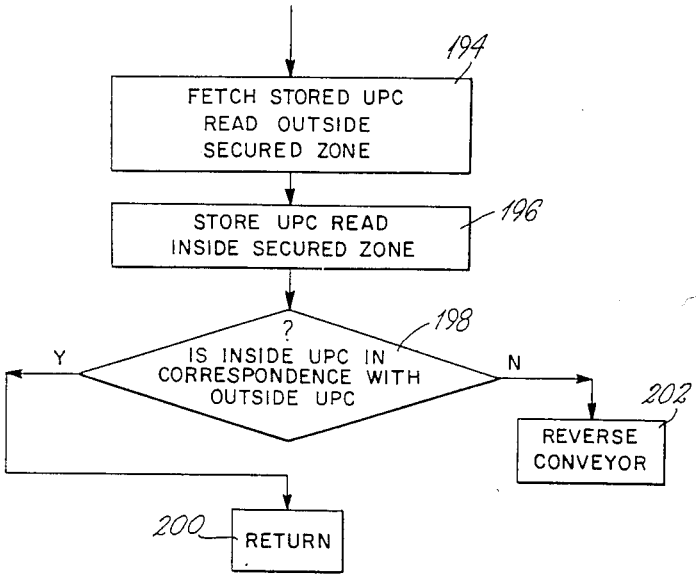

A second system version in accordance with the invention may include steps 180 and 182 of FIG. 7 and then the steps shown in FIG. 8. In step 194 (FETCH STORED UPC READ OUTSIDE SECURED ZONE), the CPU obtains the code stored in step 182. In step 196 (STORE UPC READ INSIDE SECURED ZONE), the CPU looks to its input line 132 of FIG. 4 and obtains the output of inside reader 130. In step 198 (? IS INSIDE UPC IN CORRESPONDENCE WITH OUTSIDE UPC), the CPU effects the required comparison for the second system version. If the comparison is affirmative, flow proceeds to step 200 (RETURN), which is intended to connote a returning to the outset, i. e., step 180. Otherwise, step 202 is practiced (REVERSE CONVEYOR).

Figure 9:
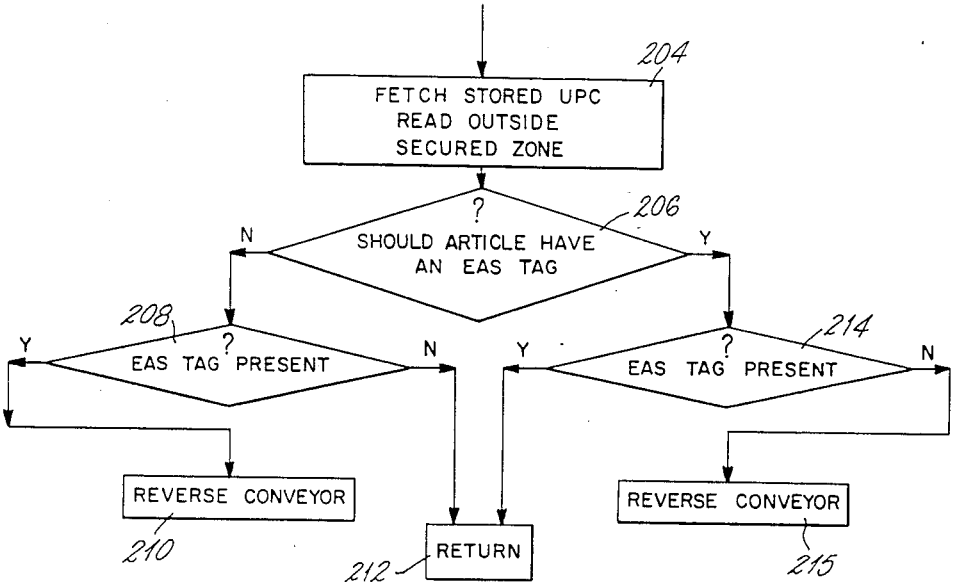

A third system version in accordance with the invention may also include steps 180 and 182 of FIG. 7 and then the steps shown in FIG. 9. In step 204 (FETCH STORED UPC READ OUTSIDE SECURED ZONE), the CPU obtains the code stored in step 182. The inquiry is now made of step 206 (? SHOULD ARTICLE HAVE AN EAS TAG). In implementing the system under discussion, one approach is that of selective EAS-tagging of articles, e. g., to tag only the more expensive articles which are more suspect to fraud on the part of a customer. For instance, in a facility selling expensive wines, a customer aware of height and weight measurement capabilities of a system may endeavor to defeat the system by UPC-scanning an inexpensive wine bottle of like size and weight to the expensive wine bottle and then place the expensive bottle on the entry conveyor. Assuming the system in such facility not to include the second UPC reading aspect of FIG. 8, the effort at fraud would be successful if the weight and height of the expensive bottle were within target of the stored values associated with the UPC of the inexpensive wine bottle.

Considering the UPC scanned article not to be a tagged article by designation, such information would be in system store and the answer to the inquiry of step 206 would be in the negative. Flow would accordingly proceed to step 208 (?EAS TAG PRESENT) and its inquiry. In the example under discussion, the expensive wine bottle would bear a tag, and same would be known as present to the CPU from its input line 136. An affirmative under these circumstances to the inquiry of step 208 will give rise to practice of step 210 (REVERSE CONVEYOR) and article rejection. Where there is no fraudulent substitution, and the inexpensive wine bottle is indeed in the secured zone, the inquiry of both steps 206 and 208 will be answered in the negative and step 212 (RETURN) is reached.

Practice complemental to that of steps 206 through 210, if desired, will occur when the step 206 inquiry is answered in the affirmative. Thus, step 206 (? EAS TAG PRESENT) would be answered in the affirmative and flow would be to step 214. In the event that there should be a tag on the article and it is not present, step 215 (REVERSE CONVEYOR) is reached and the article is reversed.

Figure 10:
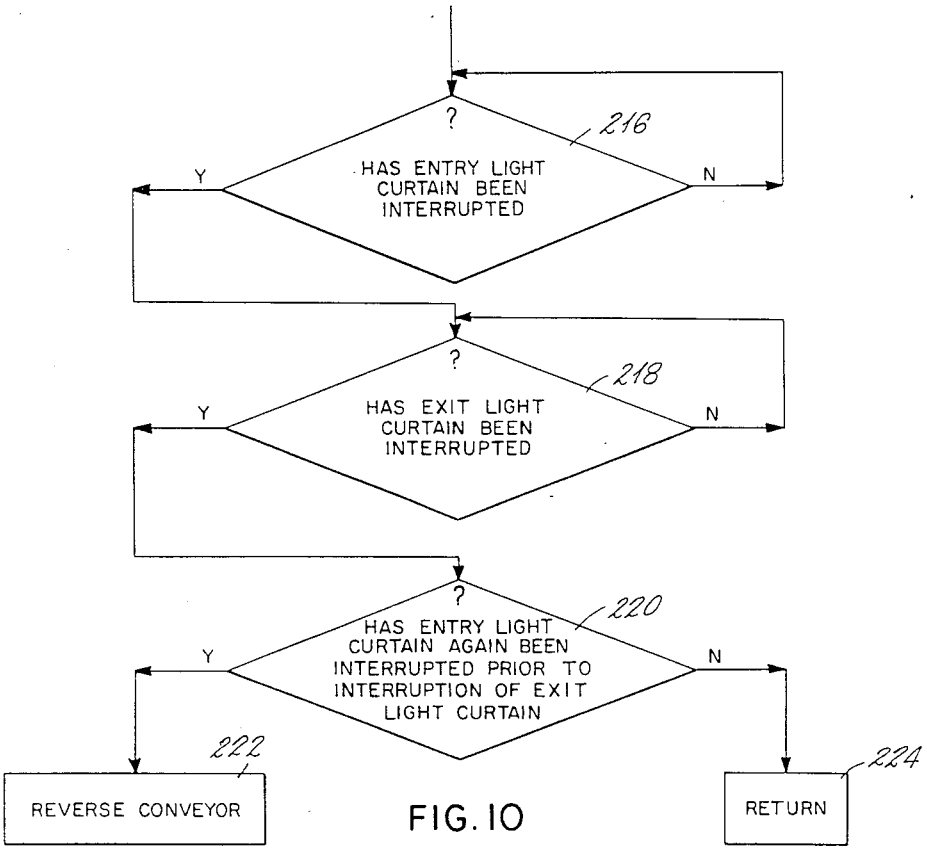

In each of the several discussed versions of systems in accordance with the invention, a light curtain routine such as that shown in FIG. 10 can be implemented to detect violation of same. By the inquiry of step 216 (? HAS ENTRY LIGHT CURTAIN BEEN INTERRUPTED), the CPU is apprised of the entry of an article into the secured zone. In the absence of affirmative reply, the routine cycles through this step. On affirmative reply, obtained by CPU inspection of lines 110 input thereto, flow proceeds to step 218 (? HAS EXIT LIGHT CURTAIN BEEN INTERRUPTED) and the routine cycles again until positive reply. This brings on step 220 (? HAS ENTRY LIGHT CURTAIN AGAIN BEEN INTERRUPTED PRIOR TO INTERRUPTION OF EXIT LIGHT CURTAIN), wherein the CPU resolves by use of its various inputs the issue of whether the entry light curtain has been interrupted, other than by anticipated and discerned entry of other articles as indicated by correspondence in number of UPC reading and entry of other articles, prior to exit of the article under consideration. If the answer to the step 220 inquiry is positive, step 222 (REVERSE CONVEYOR) is practiced. Otherwise, flow is to step 224 (RETURN).

Figure 12:
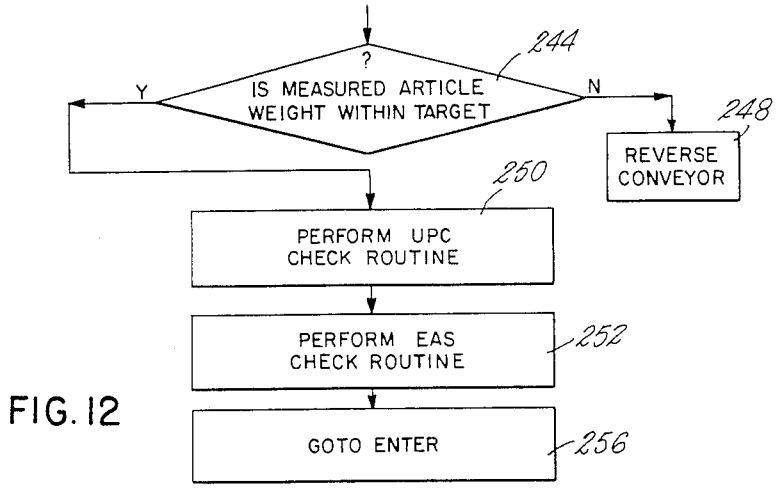
Figure 11:
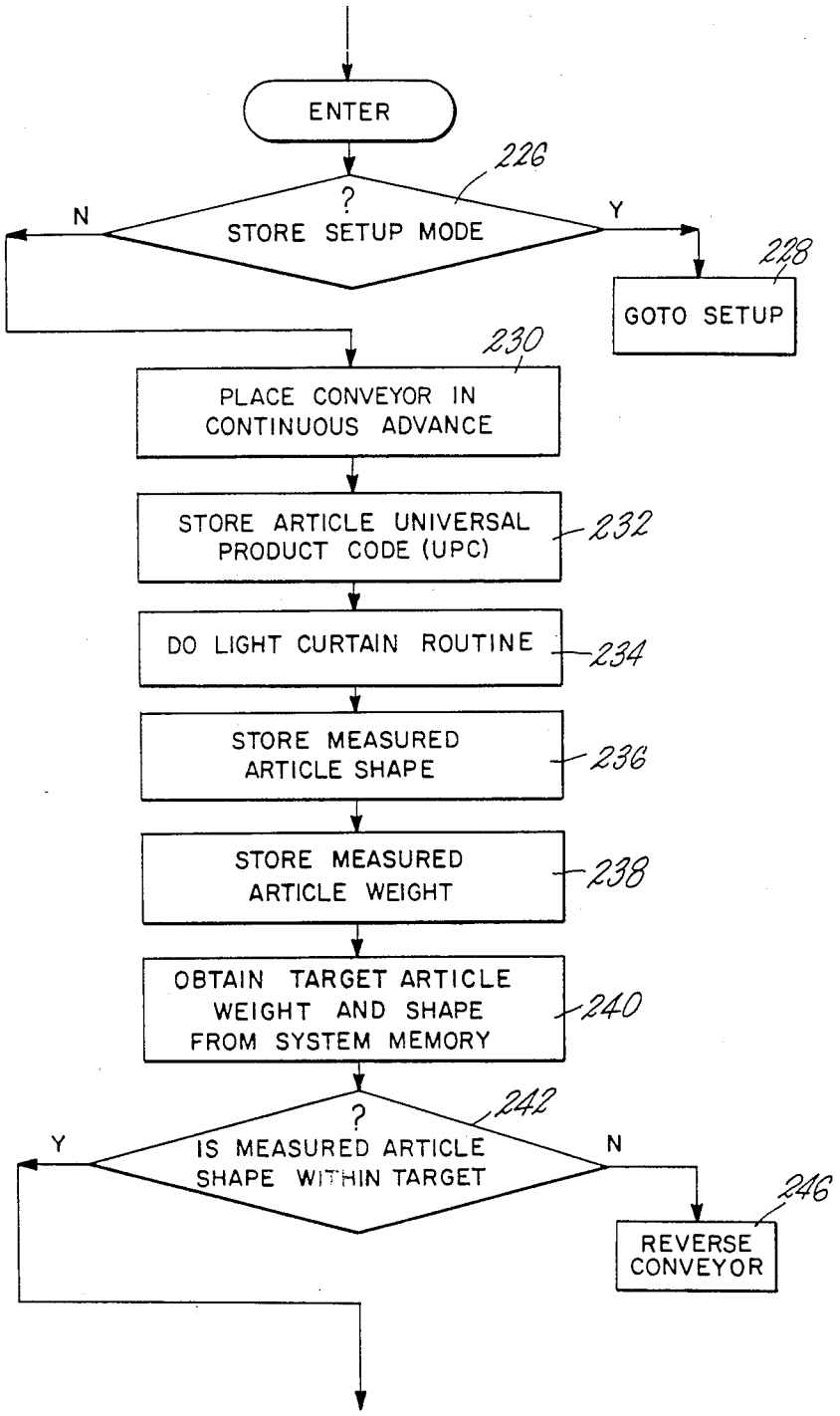

A composite version of system in accordance with the invention may follow the flowchart of FIGS. 11 and 12. Following ENTER, step 226 (? STORE SETUP MODE) inquires as to whether the system should proceed to a mode discussed below in which it itself compiles the system data base by processing output signals of its various components and loading memory therefrom. If yes, flow would be to step 228 (GOTO SETUP), which is practiced as discussed in connection with FIG. 13 below. Assuming the contrary, step 230 is reached (PLACE CONVEYOR IN CONTINUOUS ADVANCE), and then step 232 (STORE ARTICLE UNIVERSAL PRODUCT CODE (UPC)), both discussed above.

Step 234 is now reached (DO LIGHT CURTAIN ROUTINE) wherein the system looks to violation of its light curtains as above discussed. In step 236 (STORE MEASURED ARTICLE SHAPE), the system operates as previously covered. Step 238 (STORED MEASURED ARTICLE WEIGHT), calls for the CPU to look to its line 100 input signal from article weight sensor 43 of FIG. 4 and to store such indication. In step 240 (OBTAIN TARGET ARTICLE WEIGHT AND SHAPE FROM SYSTEM MEMORY), the CPU prepares for the comparisons of measured and stored height in step 242 (? IS MEASURED ARTICLE SHAPE WITHIN TARGET) and of measured and stored weight in step 244 (? IS MEASURED ARTICLE WEIGHT WITHIN TARGET). If either of these inquiries are answered negatively, flow proceeds to the corresponding REVERSE CONVEYOR practice in steps 246 and 248.

If the inquiries of both of steps 242 and 244 are answered in the affirmative, flow proceeds to step 250 (PERFORM UPC CHECK ROUTINE), wherein the above-discussed routine involving comparison of outside and inside detected UPCs is practiced. Following acceptance of the article in step 250, the system advances to step 252 (PERFORM EAS CHECK ROUTINE), wherein the above-discussed routine involving EAS tag detection and processing is practiced. On successful EAS examination, the system returns via step 256 (GOTO ENTER).

Figure 13:
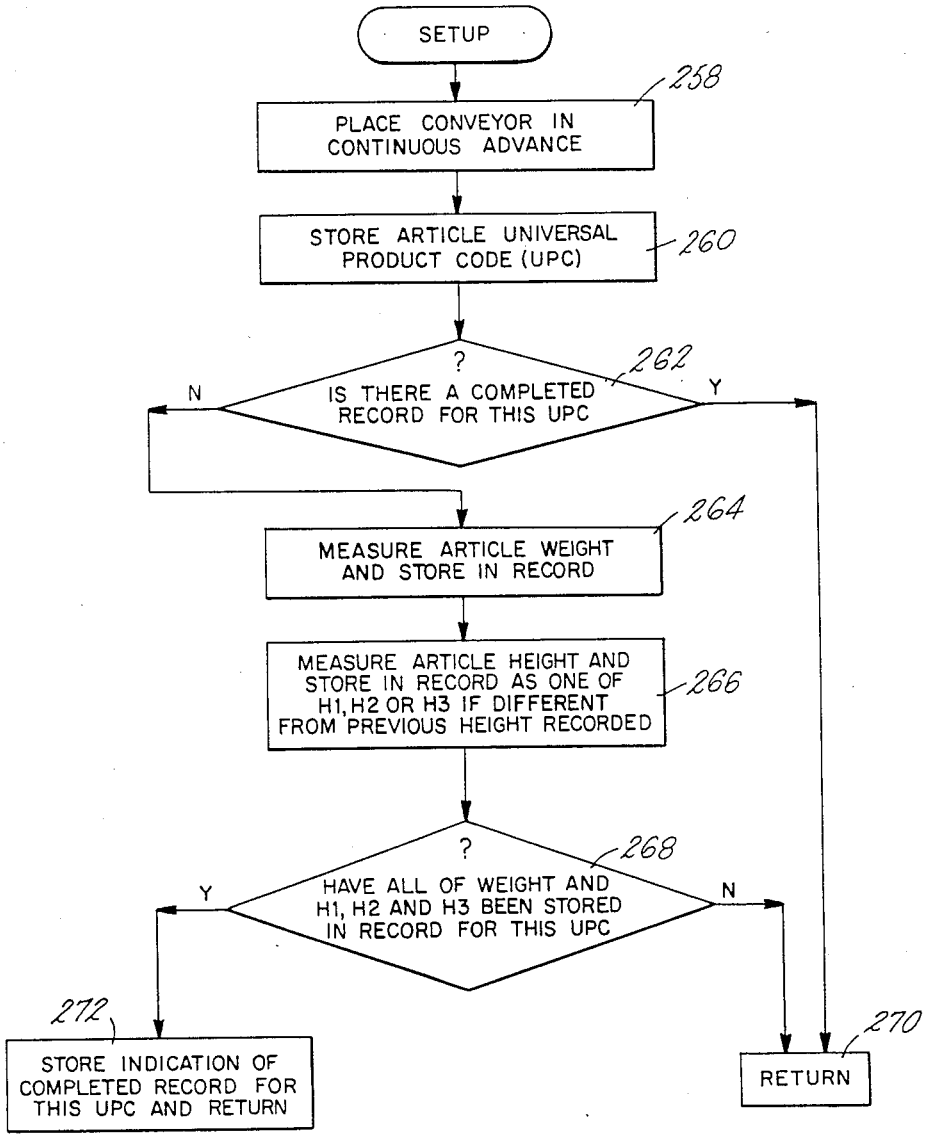

The SETUP mode of operation of the invention is shown broadly in the flowchart of FIG. 13. As alluded to above, this system mode permits the compilation of an independent store of data useful in its operation in the several embodiments heretofore discussed, thereby gaining an independence from the UPC-related data base of the facility in which the system may be installed. Of course, the in-place facility data base may be used in the absence of SETUP in the foregoing systems.

Turning to FIG. 13, in entering SETUP, step 258 (PLACE CONVEYOR IN CONTINUOUS ADVANCE) and step 260 (STORE ARTICLE UNIVERSAL PRODUCT CODE (UPC) are practiced as above discussed. In step 262 (? IS THERE A COMPLETED RECORD FOR THIS UPC), the inquiry is whether, by reason of previous operation of SETUP for the UPC at hand, a complete record of needed information has been compiled. If the answer to this inquiry is affirmative, then flow is to step 270 (RETURN). If negative, flow is to step 264 (MEASURE ARTICLE WEIGHT AND STORE IN RECORD), wherein the weight sensor output for the article on the conveyor is stored as the target weight. Desirably, such stored weight is given only transitional merit and is not considered the target or fully established value for the data base until the same article again is considered for weight in subsequent SETUP and concurrence between the transitionally stored and subsequently measured weight occurs. For the broad flowchart of FIG. 13, however, the initially taken weight measure is taken as the established target weight.

In the course of transport of articles through the entry light curtain, an article may exhibit as many as three quite different heights. Considering canned goods, same may be upright, in which case the light curtain will measure the length of the cylindrical an as its height, or it may be lying on its side, in which case the light curtain will measure the can diameter as its height. In the case of a box, same has three possible dimensions, length, width and height, each of which can be presented to the light curtain depending on the disposition of the box on the conveyor.

SETUP preferably looks to the storage of all possible acceptable light curtain or article shape sensor measurements for each article. This practice is undertaken seriatim each time the article passes through the light curtain in successive SETUP practices in step 266 (MEASURE ARTICLE HEIGHT AND STORE IN RECORD AS ONE OF H1, H2 OR H3 IF DIFFERENT FROM PREVIOUS HEIGHT RECORDED). Typically, measured height is compared with previously stored height or heights in the article record. If the currently measured value does not correspond to a previously stored value, and the record is not complete, the measure is adopted as one of H1, H2 or H3, as the case may be. Redundancy is also the desirable practice in this instance, as noted above for weight, but it omitted for convenience from the broad flowchart of FIG. 13.

In step 268 (? HAVE ALL OF WEIGHT AND H1, H2 AND H3 BEEN STORED IN RECORD FOR THIS UPC), inquiry is made as to whether the record for the article under consideration is complete. If the answer is negative, a RETURN is made in step 270. If affirmative, step 272 (STORE INDICATION OF COMPLETED RECORD FOR THIS UPC AND RETURN) is practiced such that information is available to permit a RETURN directly upon the inquiry in step 262 above discussed.

Various modifications to the foregoing systems and changes in the described methods can be made without departing from the invention. Accordingly, it will be understood that the illustrated preferred embodiments and practices are intended in an illustrative and not in a limiting sense. The true spirit and scope of the invention is set forth in the following claims.

We claim:

1. A system for processing articles selected for purchase and bearing distinct identification codes, said system comprising:

(a) code reader means for generating an output signal indicative of such article identification code;

(b) conveyor means for receipt and transport of such aricle;

(c) sentry means for defining an inlet to a security zone extending along a portion of said conveyor means, said sentry means including sensor means for generating an output signal jointly indicative of entry of said article into said security zone and of a first measurable characteristic of said article;

(d) control means for selective movement of said conveyor means in respective article acceptance and article rejection senses, said control means being operable I. for storage, for each of a plurality of such articles, of a signal indicative of a predetermined value of said first article characteristic correlated with such article identification code, II. for response to said code reader means output signal for comparison of such stored signal with said output signal of said sentry means, and III. for operation of said conveyor means selectively in response to the results of said comparison.

2. The system claimed in claim 1 wherein said control means is inclusive of storage means and is operable for compiling in such storage means, for each of a plurality of such articles, a signal indicative of a predetermined value of said first article characteristic correlated with article identification code by processing of said output signals of said code reader means and said sentry means.

3. The system claimed in claim 1 wherein said first measurable article characteristic is article shape and wherein said sentry means output signal is indicative of such article shape, said system further including article weight sensing means for generating an output signal indicative of the weight of said article on receipt thereof by said conveyor means, said control means being further operable for storage, for each of a plurality of such articles, of a signal indicative of a predetermined value of said article weight correlated with article identification code, for response to said code reader means output signal for comparison of such stored weight signal with said output signal of said weight sensing means, and for operation of said conveyor means selectively in response to the results of such weight signal comparison.

4. The system claimed in claim 1 further including EAS detection means for determining whether or not an article in said security zone is EAS-tagged, said control means being operable for storing indication, for each of a plurality of such articles, of whether or not such article should be EAS-tagged and operating said conveyor means selectively in response to such stored indication and determination.

5. The system claimed in claim 4 wherein said control means is inclusive of storage means and is operable for compiling in such storage means, for each of a plurality of such articles, a signal indicative of a predetermined value of said first article characteristic correlated with article identification code by processing of said output signals of said code reader means and said sentry means.

6. The system claimed in claim 1 further including additional code reader means in said security zone for generating an output signal indicative of such code, said control means being operable for further comparing said output signal of said first-mentioned code reader means with said output signal of said additional code reader means and operating said conveyor means selectively in response to such further comparison.

7. The system claimed in claim 6 further including EAS detection means for determining whether or not an article in said security zone is EAS-tagged, said control means being operable for storing indication, for each of a plurality of such articles, of whether or not such article should be EAS-tagged and operating said conveyor means selectively in response to such stored indication and determination.

8. The system claimed in claim 7 wherein said control means is inclusive of storage means and is operable for compiling in such storage means, for each of a plurality of such articles, a signal indicative of a predetermined value of said first article characteristic correlated with article identification code by processing of said output signals of said code reader means and said sentry means.

9. A system for processing articles selected for purchase and bearing distinct identification codes, said system comprising:

(a) first code reader means for generating an output signal indicative of such article identification code;

(b) conveyor means for receipt and transport of such article;

(c) means defining a secured zone extending along a portion of said conveyor means;

(d) second code reader means for generating an output signal indicative of such article identification code of articles in said secured zone;

(e) control means for selective movement of said conveyor means in respective article acceptance and article rejections senses, said control means being operable for comparing said output signal of said first code reader means with said output signal of said second code reader means and for operation of said conveyor means selectively in response to the results of such comparison; and (f) EAS detection means for determining whether or not an article in said security zone is EAS-tagged, said control means being further operable for storing indication, for each of a plurality of such articles, of whether or not such article should be EAC-tagged and for operating said conveyor means selectively in response to such stored indication and determination.

10. The system claimed in claim 9 wherein said system further includes sensing means for providing an output signal indicative of a measurable characteristic of said article and wherein said control means is operable for compiling a store, for each of a plurality of such articles, of a signal indicative of a predetermining value of said article characteristic correlated with article identification code by processing of said output signals of said code reader means and said sentry means, said control means being further operable for comparison of such stored signal for an article with said output signal of said sensing means and for operating said conveyor means selectively in response to the results of such comparison of such stored and measured article characteristic output signals.

11. A system for processing articles selected for purchase and bearing distinct identification codes, said system comprising:

(a) code reader means for generating an output signal indicative of such article identification code;

(b) conveyor means for receipt and transport of such article;

(c) means defining a secured zone extending along a portion of said conveyor means;

(d) sensing means for generating an output signal indicative of a measurable characteristic of said article; and (e) control means for selective movement of said conveyor means in respective article acceptance and article rejection senses, said control means being operable for compiling a store, for each of a plurality of such articles, of a signal indicative of a predetermined value of said article characteristic correlated with article identification code, by processing of said output signals of said code reader means and said sensing means, said control means being further operable for comparison of such stored signal for an article with said output signal of said sensing means and for operating said conveyor means selectively in response to the results of such comparison of such stored and measured article characteristic output signals.

12. A system for processing articles selected for purchase and bearing distinct identification codes, said system comprising:

(a) code reader means for generating an output signal indicative of such article identification code;

(b) conveyor means for receipt and transport of such article;

(c) means defining a secured zone extending along a portion of said conveyor means;

(d) EAS detection means for determining whether or not an article in said secured zone is EAS-tagged and generating a corresponding output signal; and (e) control means for selective movement of said conveyor means in respective article acceptance and article rejection senses, said control means being operable for storing indication, for each of a plurality of such articles, correlated with such article identification code of whether or not such article should be EAS-tagged, for comparing said EAS detection means output signal with said stored indication, and for operating said conveyor means selectively in response to such comparison.

13. The system claimed in claim 12 wherein said system further includes sensing means for providing an output signal indicative of a measurable characteristic of said article and wherein said control means is operable for compiling a store, for each of a plurality of such articles, of a signal indicative of a predetermined value of said article characteristic correlated with article identification code by processing of said output signals of said code reader means and said sensing means, said control means being further operable for comparison of such stored signal for an article with said output signal of said sensing means and for operating said conveyor means selectively in response to he results of such comparison of such stored and measured article characteristic output signals.

14. A method for use in purchase checkout of articles having respective unique identification codes therewith, said method comprising the steps of:

(a) discerning such identification code for an article selected for purchase;

(b) disposing such selected article in a secured zone and therein,

I. measuring a characteristic of such secured zone disposed article and

II.

A. again discerning such identification code for said article, and

B. examining said article by EAS practice; and (c) rejecting said disposed article from such secured zone and returning to the purchaser upon I. failure of correspondence of such measured article characteristic with a stored predetermined value of such article characteristic, or

II.

A. failure of correspondence of such second discerned identification code for said article with such first discerned identification code therefor, and B. failure of such article to pass such EAS practice.

15. A method for use in purchase checkout of articles having respective unique identification codes therewith, said method comprising the steps of:

(a) discerning such identification code for an article selected for purchase;

(b) disposing such selected article in a secured zone and therein,

I. measuring a characteristic of such secured zone disposed article and

II. examining said article by EAS practice; and (c) rejecting said disposed article from such secured zone and returning to the purchaser upon I. failure of correspondence of such measured article characteristic with a stored predetermined value of such article characteristic, or II. failure of such article to pass such EAS practice.

16. The method claimed in claim 15 wherein said article characteristic is article shape.

17. The method claimed in claim 16 including the further practice of measuring article weight and rejecting said disposed article from said secured zone and returning same to said purchaser upon failure of correspondence of such measured weight with a stored predetermined value of weight for said article.

* * * * *